United States Patent [19]

Forni

[11] Patent Number: 4,715,206

[45] Date of Patent: Dec. 29, 1987

[54] ROLLING STAND OF THE TYPE WITH TIE-RODS WITH OSCILLATING SUPPORTS WITH INTERCHANGEABLE INTERMEDIATE HOLDER BASES

[75] Inventor: Luigi Forni, Castellanza, Italy

[73] Assignee: Pomini Farrel S.p.A., Castellanza, Italy

[21] Appl. No.: 45,222

[22] Filed: Apr. 29, 1987

Related U.S. Application Data

[63] Continuation of Ser. No. 736,756, May 22, 1985, abandoned.

[30] Foreign Application Priority Data

May 28, 1984 [IT] Italy ..... 21129A/84

[51] Int. Cl.[4] ..... B21B 31/04; B21B 31/08; B21B 13/08

[52] U.S. Cl. ..... 72/237; 72/225; 72/238; 72/245; 72/248

[58] Field of Search ..... 72/225, 237, 238, 239, 72/245, 248

[56] References Cited

U.S. PATENT DOCUMENTS

| | | | |
|---|---|---|---|
| 3,217,525 | 11/1965 | Howard | 72/237 |
| 3,899,910 | 8/1975 | Aramaki | 72/225 X |
| 3,948,072 | 4/1976 | Aramaki | 72/225 |
| 4,127,997 | 12/1978 | Quehen | 72/225 X |
| 4,557,130 | 12/1985 | Bond | 72/225 |

FOREIGN PATENT DOCUMENTS

| | | | |
|---|---|---|---|
| 0103989 | 3/1984 | European Pat. Off. | 72/239 |

*Primary Examiner*—Robert L. Spruill
*Assistant Examiner*—Steve Katz
*Attorney, Agent, or Firm*—Morgan & Finnegan

[57] ABSTRACT

A rolling stand of the type with tie-rods that, in addition to being suitable to be easily replaced, dismantled and reassembled, it is also capable of being transformed from a two-high stand, having only a pair of parallel and motor-driven rolls, into a universal stand, composed, in addition to the pair of parallel rolls, by a further two vertical idle rolls, opposed to each other, and perpendicular to the previously mentioned cylinders.

10 Claims, 6 Drawing Figures

ROLLING STAND OF THE TYPE WITH TIE-RODS WITH OSCILLATING SUPPORTS WITH INTERCHANGEABLE INTERMEDIATE HOLDER BASES

This is a continuation of co-pending application Ser. No. 736,756, filed on May 22, 1985, now abandoned.

TECHNICAL FIELD

The present invention relates to a rolling stand of the type provided with tie-rods, wherein freely removable holder and supporting bases are contemplated, capable of making the same stand suitable to be transformed quickly and in a rather cheap way. More precisely, said holder bases allow a normal two-high stand to be transformed into a "universal" stand comprising two pairs of rolls opposed to each other, and essentially perpendicular to each other.

BACKGROUND AND OBJECTS OF THE INVENTION

Rolling stands are known, which essentially comprise rolls rotatably supported by roll supporting means mutually tightened through a set of tie-rods, each one of said tie-rods reacting on two pins rotatably assembled within one of said roll supporting means.

Stands having such a structure do not allow a great flexibility in production, in that they require long times for the replacement of the rolling rolls, when the profile to be produced is varied.

Their structure moreover does not always allow such a production diversification, in that it is not possible to produce by means of such a stand, e.g. parallel-flange beams, if the same stand is not provided with particular supports for pairs of additional, so-called vertical rolls.

The main purpose of the present invention is to provide a rolling stand of the type with tie-rods, allowing a wide range of shapes to be manufactured, and wherein the production diversification can be carried out by means of quick and simple replacements.

SUMMARY OF THE INVENTION

These and further purposes are achieved, according to the present invention, by providing a rolling stand of the two-high stand type, essentially comprising four tie-rods provided with oscillating supports holding in their turn rolling rolls, said tie-rods being positioned above a bed frame of said stand and motor means being provided for driving said tie-rods for the opening and the closure of said rolls, characterized in that above said bed frame intermediate bases are provided for support and reaction for said tie-rods and for said supports, means being provided of constraint of said bases to said bed frame.

BRIEF DESCRIPTION OF THE DRAWINGS

The structural and functional characteristics and the advantages of a rolling stand having the structure according to the present invention shall be better understood from the following disclosure relating to exemplifying but not limitative embodiments referring to the schematic drawings, wherein.

DETAILED DESCRIPTION OF THE PREFERRED EMBODIMENTS

Figure 1:
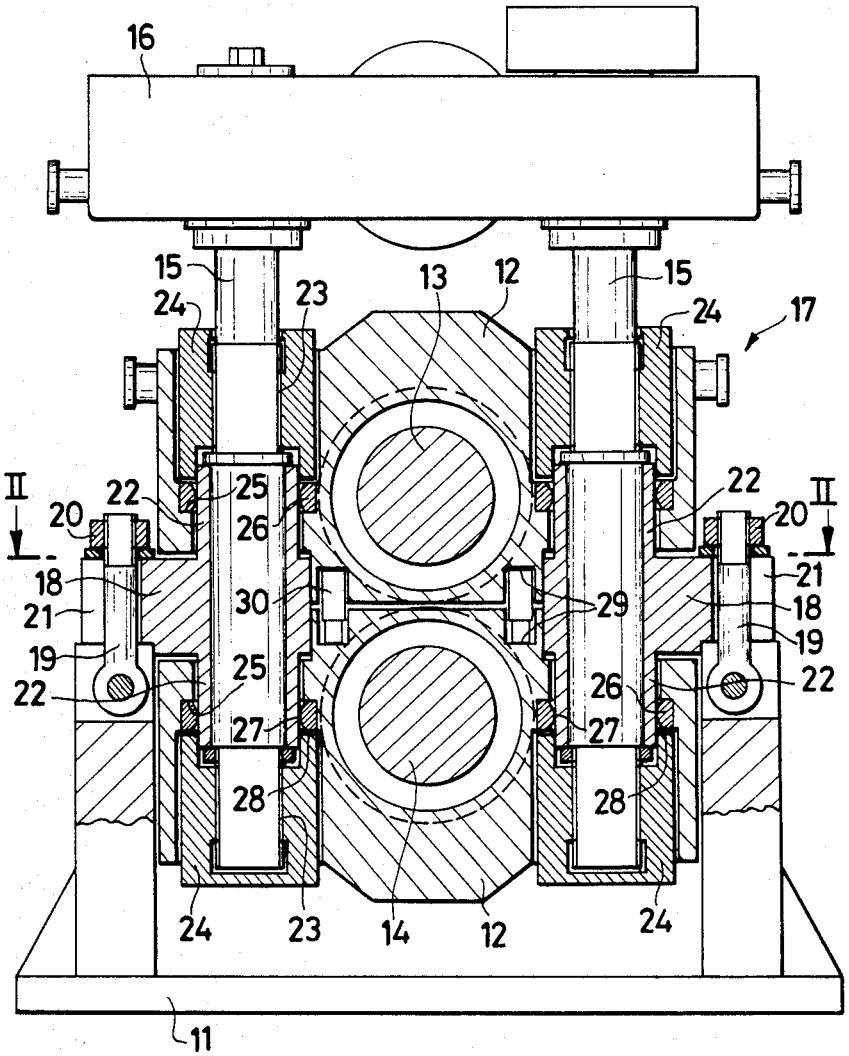
FIG. 1 is a general schematic sectional elevation side view of a stand according to the present invention.

Referring to the drawings, a rolling stand comprises essentially a bed plate 11 holding, suitably positioned within supports and/or packings 12 a pair of rolling rolls 13, 14, tie-rods 15 being provided for the relative positioning of the upper roll 13 and the lower roll 14, driven by an adjustment and synchronization unit 16 placed atop the stand.

Figure 2:
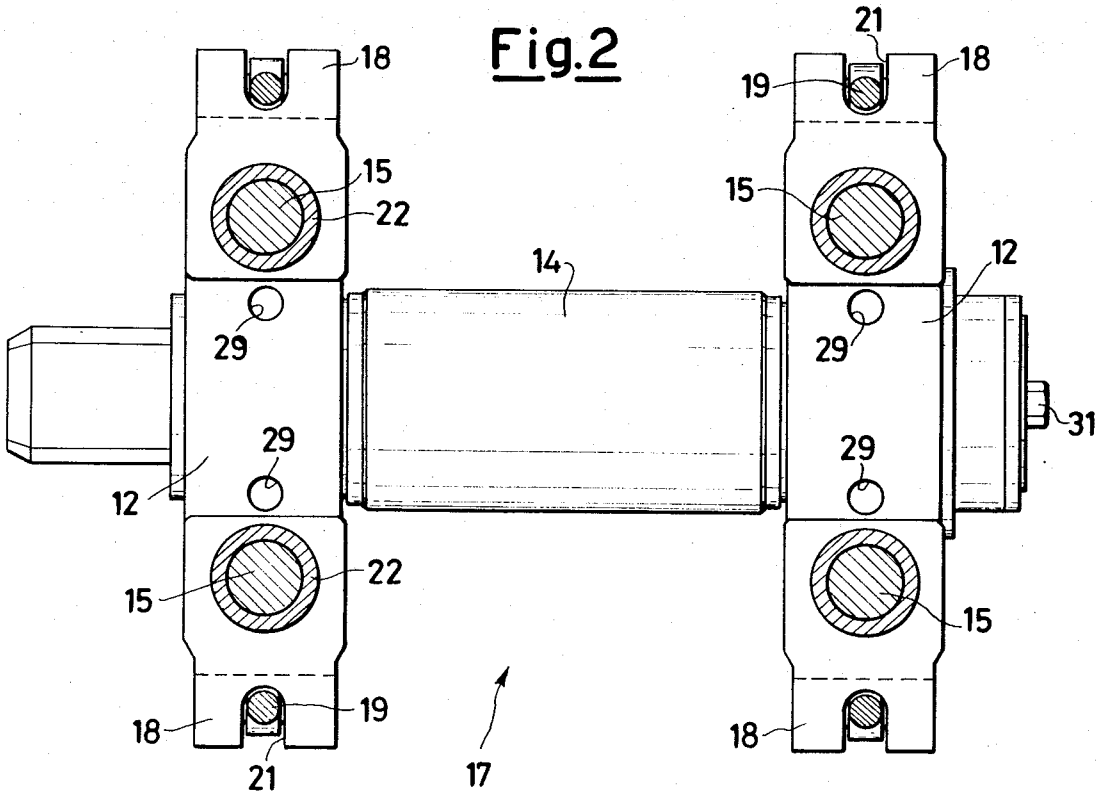
FIG. 2 is a sectional plan view according to the line II—II of FIG. 1.
Figure 3:
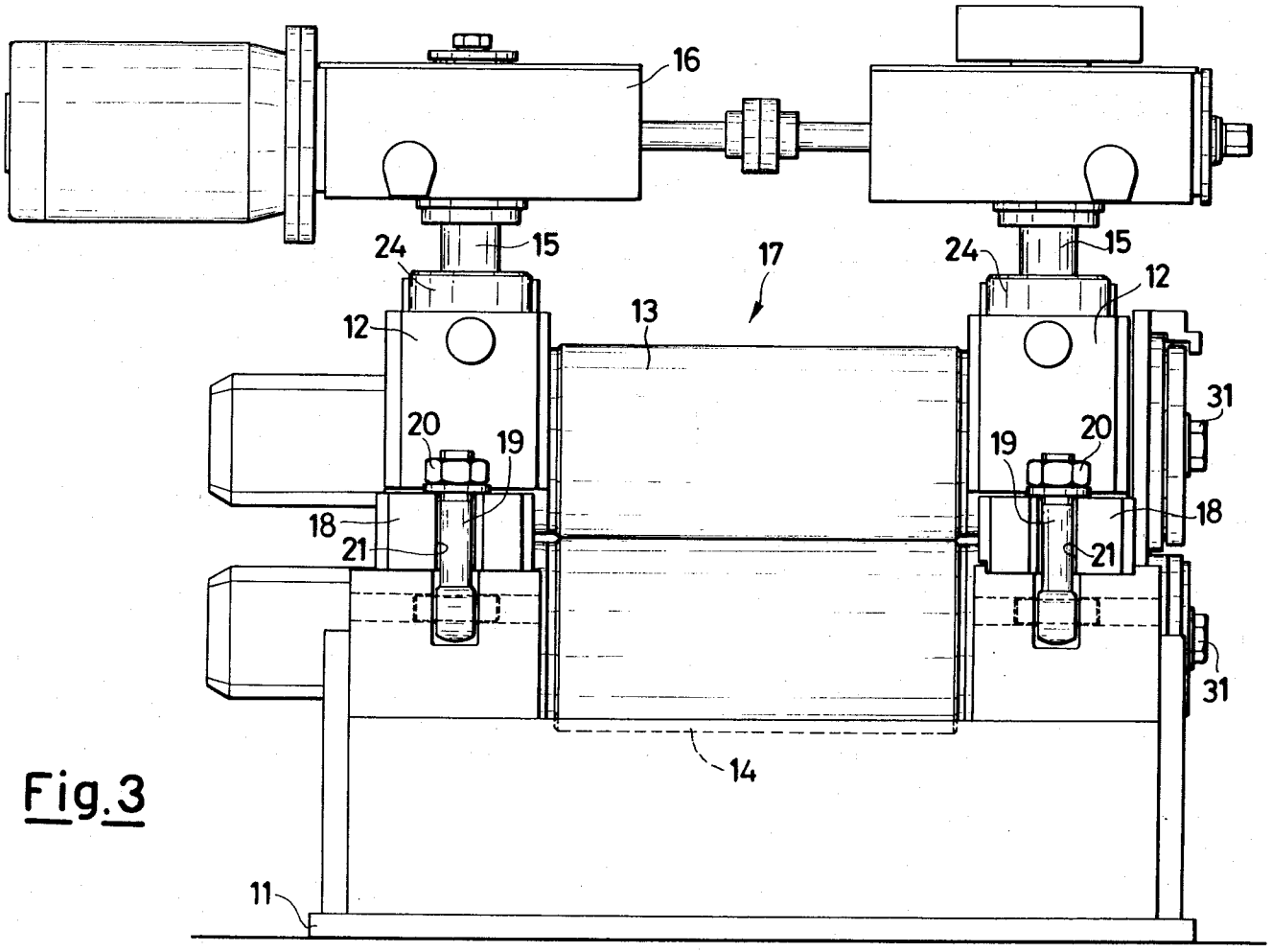
FIG. 3 is a schematic front elevation view of the stand of FIG. 1.

More precisely, FIGS. 1, 2 and 3 show a two-high stand, generally indicated with 17, provided, above its bed frame 11, with a first set of four holder bases or holder feet 18 which are constrained to said bed frame by means of four eye pressure bolts 19 and of four related nuts 20 within seats 21 of the bases 18.

Two sleeves 22, provided in each base 18 and protruding therefrom, contain and support the four tie-rods 15, each of said tie-rods 15 engaging by means of two threaded lengths 23, provided on opposite sides relatively to the base 18, threaded nuts 24 solid as for rotation with the supports 12. The nuts 24 and the related shoulders 25 in the supports 12 hold rings 26 crowned in 27 in an inner intermediate position, wherein they interact slidingly on the outer surface of the sleeves 22; and provided with protruding sectors, having a rounded cup-like shape 28, provided on diametrically-opposite parts on a transversal face where they interact with the nut 24, thus allowing the supports 12 to oscillate together with their related rolls 13 and 14 relatively to the holder bases 18.

Between the supports 12 of the upper roll 13 and the supports 12 of the lower roll 14 within related seats 29 four jacks 30 determining the pre-load of the stand are provided.

The rolls 13, 14 are removed from the stand and replaced in a very quick way, by means of suitable toolings, by removing the screws 31 of axial locking relatively to the supports 12 and horizontally opening the shoulders of the stand.

Figure 4:
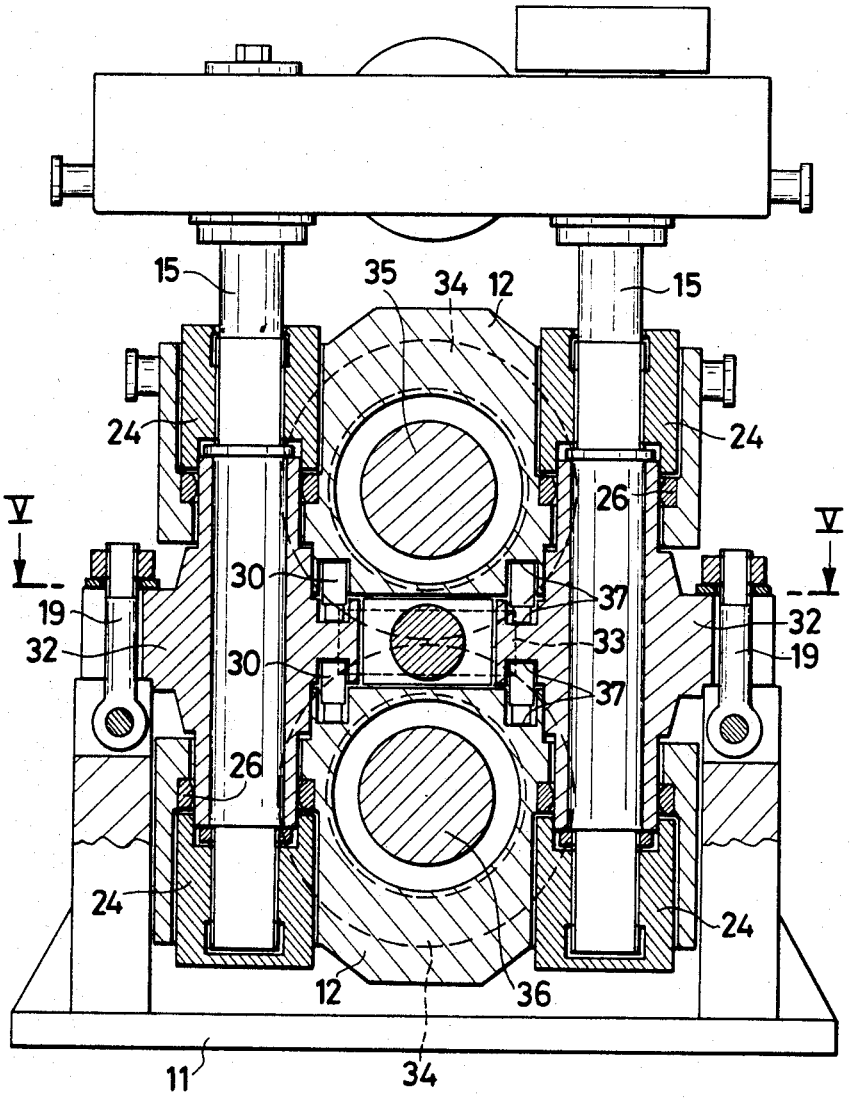
FIG. 4 is a sectional side elevation view of a universal stand according to the invention.
Figure 5:
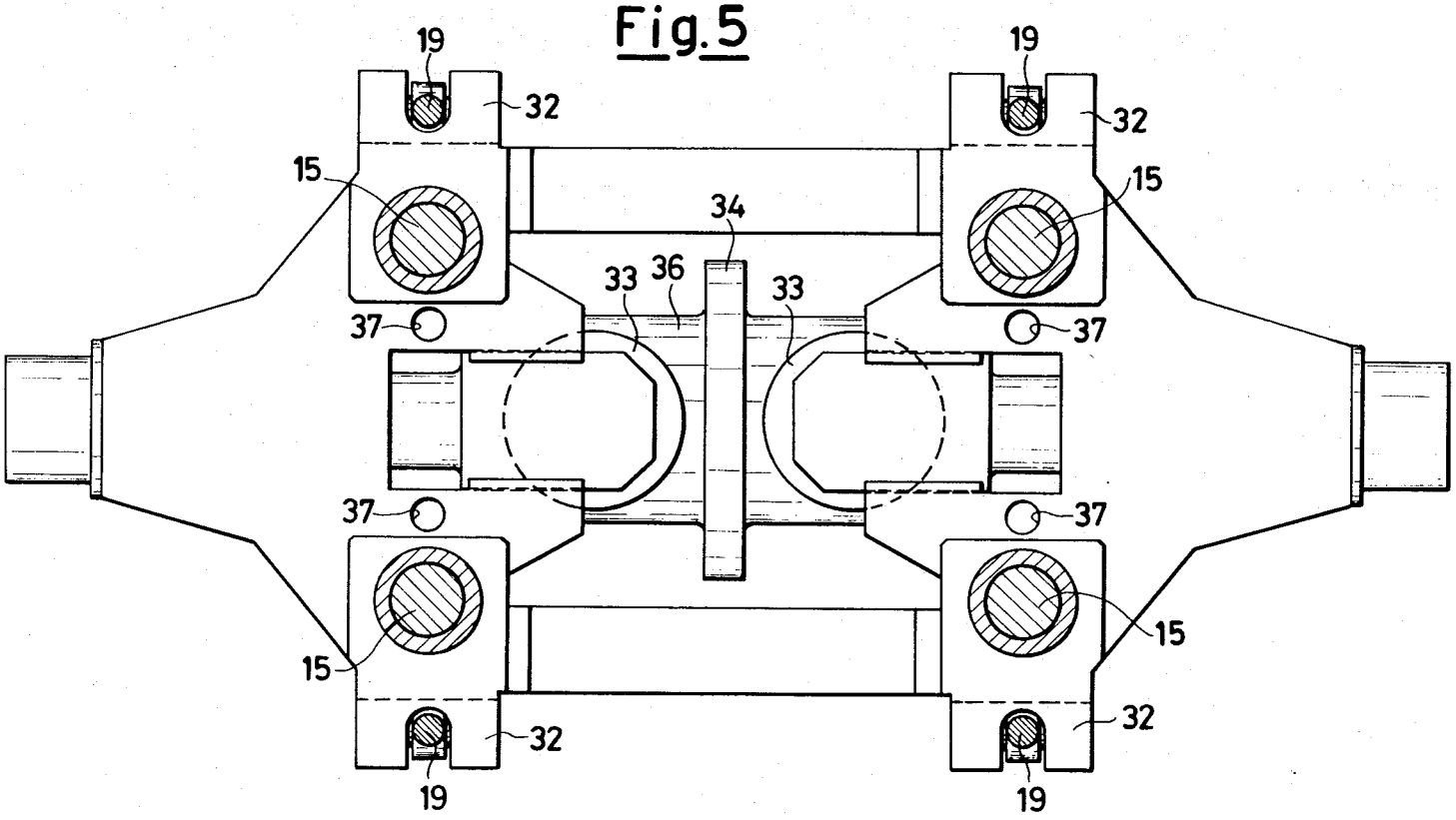
FIG. 5 is a sectional plan view according to the line V—V of FIG. 4.
Figure 6:
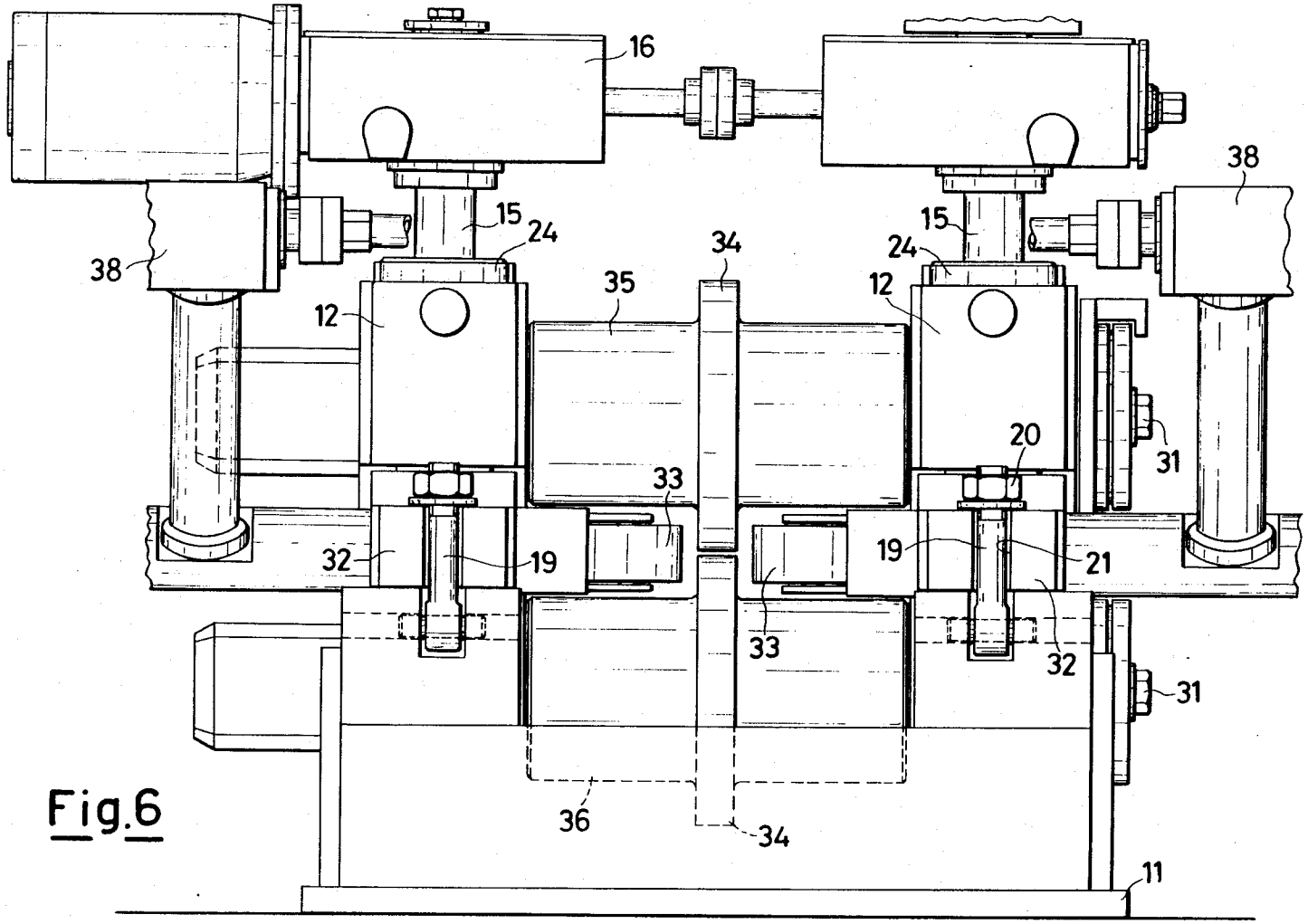
FIG. 6 is a schematic front elevation view of the stand of FIG. 4.

FIGS. 4, 5 and 6 show how a two-high stand according to the invention of the type just disclosed can be quickly transformed into a stand of universal type by removing the four bases 18 and replacing them with two wide bases 32, such bases 32 too being fastened to the bed frame 11 by means of pressure bolts 19.

A second set of holder bases 32 house and support each one in its interior a vertical idle roll 33, whose position can be adjusted relatively to a protruding profile 34 of two horizontal rolls 35 and 36, by means of a related drive unit 38. Moreover, each one of the two holder bases 32 is provided with four half-seats 37 for the positioning of four upper jacks 30 and four lower jacks 30.

The advantage and the usefulness results thus clear of the present invention, which allows, in a stand essentially of the type wherein the opening and the closure of the rolls is carried out by means of tie-rods with contrary threads, through the introduction of replaceable holder bases, in a central position relatively to said tie-rods, to make it suitable to be transformed in a quick and simple way from a "normal" two-high stand into a "universal" stand for complex profiles.

It should be noted that thanks to the positioning of the pressure bolts 19, the replacement of the supporting elements 12 is particularly easy, because it is sufficient to that purpose to loosen the nuts 20 of the pressure bolts 19 and turn the same pressure bolts around their eye, so as to liberate the holder bases 18 or 32.

Once that the adapters, not shown, have been disconnected, the supports 12 can be replaced, by raising them up by means of the suitable connections.

Their re-positioning can be carried out in an equivalent way, it resulting therefore very quick and easy.

It is thus clear that each type of intervention, both for the replacement of the rolls and for the transformation of the stand is extremely fast and simple.

Moreover, rolling stands with holder bases according to the invention are suitable to be opened horizontally, i.e. by spacing wide apart the shoulders containing the roll supporting elements and the supports, in order to remove the rolls, which remain in their position, and replace them with a new pair, both the old and the new rolls being supported on a suitable maintenance unit which is the object of the U.S. patent application No. 615,838 filed on May 31, 1984, now U.S. Pat. No. 4,552,007.

I claim:

1. A convertible rolling stand comprising:

a bed frame;

intermediate holder bases having outwardly projecting portions, said outwardly projecting portions being configured and dimensioned to rest on and be removably secured to said bed frame;

four vertical tie rods rotatably housed in said intermediate holder bases, each said tie rod having upper and lower threaded sections protruding out of said holder bases;

upper and lower roll supports each rotatably supporting a horizontal roll, said upper roll support having nut seats securely housing threaded nuts corresponding to and engaging said upper threaded sections of said tie rods, said lower roll support having nut seats securely housing threaded nuts corresponsing to and engaging said lower threaded sections of said tie rods, said threaded nuts being non-rotating relative to said upper and lower roll supports;

drive means connected to said tie rods for rotating said tie rods relative to said roll supports, thereby causing said threaded nuts to be axially displaced on said tie rods such that said upper and lower roll supports are adjusted relative to each other; and jack means engaging said upper and lower roll supports for urging said roll supports away from each other such that said roll supports are biased against said threaded nuts and tie rods.

2. The rolling stand according to claim 1, wherein said intermediate holder bases further comprise four holder bases, each of said four holder bases supporting one of said four tie rods.

3. The rolling stand according to claim 1, wherein said intermediate holder bases further comprise two holder bases, each of said two holder bases supporting two of said four tie rods.

4. The rolling stand according to claim 1, wherein said intermediate holder bases include at least one pair of vertical rolls substantially perpendicular to said horizontal rolls, such that when said intermediate holder bases are disposed on said bed frame said horizontal rolls and said vertical rolls provide a universal rolling stand.

5. The rolling stand according to claim 1, wherein said jack means are disposed between said roll supports.

6. The rolling stand according to claim 1, wherein said jack means are disposed between said intermediate holder bases and said roll supports.

7. The rolling stand according to claim 1, further comprising eye pressure bolts pivotally mounted to said bed frame and insertable into outwardly open seats of said outwardly protruding portions of said intermediate holder bases for clamping said outwardly protruding portions of said intermediate holder bases to said bed frame.

8. The rolling stand according to claim 1, wherein said nut seats of said roll supports define inner shoulders for receiving holding rings, said holding rings having rounded inner surfaces engaging tubular portions of said holder bases.

9. The rolling stand according to claim 1, wherein said drive means are supported by said four tie rods.

10. The rolling stand according to claim 1, wherein said nut seats of said roll supports are of sufficient depth to house the major part of said threaded nuts.

* * * * *